United States Patent [19]

Mock

[11] 4,302,317

[45] Nov. 24, 1981

[54] MEANS FOR RECOVERING A PRECIOUS METAL FROM AN ELECTROLYTE SOLUTION CONTAINING IONS OF SAID METAL

[76] Inventor: Karl J. Mock, 685 Bogert Rd., River Edge, N.J. 07661

[21] Appl. No.: 130,567

[22] Filed: Mar. 14, 1980

Related U.S. Application Data

[63] Continuation of Ser. No. 673,594, Apr. 5, 1976, abandoned, which is a continuation of Ser. No. 354,432, Apr. 25, 1973, abandoned.

[51] Int. Cl.[3] ..... C25B 15/08; C25C 7/06; C25C 1/20

[52] U.S. Cl. ..... 204/228; 204/237; 204/272; 204/273; 204/275; 354/297; 354/324

[58] Field of Search ..... 204/109, 272, 273, 228, 204/275; 354/297, 324

[56] References Cited

U.S. PATENT DOCUMENTS

| | | | |
|---|---|---|---|
| 2,997,438 | 8/1961 | James et al. | 204/273 |
| 3,694,341 | 9/1972 | Luck, Jr. | 204/272 X |
| 3,715,299 | 2/1973 | Anderson et al. | 204/109 X |
| 3,926,768 | 12/1975 | Burgess | 204/273 X |
| 4,028,212 | 6/1977 | Bowen et al. | 204/273 X |
| 4,149,954 | 4/1979 | Ransbottom | 204/109 X |

FOREIGN PATENT DOCUMENTS

| | | | |
|---|---|---|---|
| 916438 | 1/1963 | United Kingdom | 204/272 |
| 1123168 | 8/1968 | United Kingdom | 204/272 |

*Primary Examiner*—Delbert E. Gantz
*Assistant Examiner*—Donald R. Valentine
*Attorney, Agent, or Firm*—Hopgood, Calimafde, Kalil, Blaustein & Judlowe

[57] ABSTRACT

The invention contemplates recovery of silver (a precious metal) from waste photographic-fixer solution, the apparatus being so devised and controlled that high purity is achieved in the reclaimed metal without contamination of the remaining solution. As a result, the remaining solution may be recycled, and requirements for replenishment of fixer chemical are held to minimum quantities. In an automated employment of the invention, assurance is provided that electroplating action will be called for only when it can be safely performed, without impairment of quality in the reclaimed metal or in the recycled solution.

33 Claims, 5 Drawing Figures

MEANS FOR RECOVERING A PRECIOUS METAL FROM AN ELECTROLYTE SOLUTION CONTAINING IONS OF SAID METAL

This application is a continuation of my copending application, Ser. No. 673,594, filed Apr. 5, 1976, now abandoned, and said copending application is a continuation of my original application, Ser. No. 354,432, filed Apr. 25, 1973, now abandoned.

This invention relates to silver-recovery apparatus for use with waste photographic-fixer solution.

Conventional apparatus of the character indicated employs carbon anodes which are subject to gradual disintegration, thus providing a contaminant for the solution and giving rise to a variable plating-current density, as the electrode is consumed. The solution is not reusable, and the recovery of silver (a precious metal) is only in the order of 40 to 60 percent of that which is available. Moreover, the silver that is recovered is not of the best quality, so that further refining steps are needed. In general, the shortcomings of the conventional technique limit its use essentially to large commercial photo processing firms and laboratories, and the matter of anode servicing and replacement is a major maintenance factor.

It is accordingly an object of the invention to provide improved apparatus of the character indicated.

Another object is to provide such apparatus which will inherently produce substantially greater yields of metallic silver (a precious metal), exceeding 90 percent of that available, and at the same time yielding higher-quality silver than heretofore.

A further object is to meet the above objects with apparatus that is relatively small, odor-free, and simple to maintain and which can therefore serve institutions, such as hospitals, which only incidentally must perform their photographic processing of X-ray negatives.

A specific object is to provide a device of the character indicated which will permit recycled use of fixer solution from which substantially all silver has been recovered.

Another specific object is to provide a device of the character indicated with means whereby it can function in conjunction with automatic or semi-automatic photo-processing installations.

Other objects and various further features of novelty and invention will be pointed out or will occur to those skilled in the art from a reading of the following specification in conjunction with the accompanying drawings. In said drawings, which show, for illustrative purposes only, preferred forms of the invention:

Figure 1:
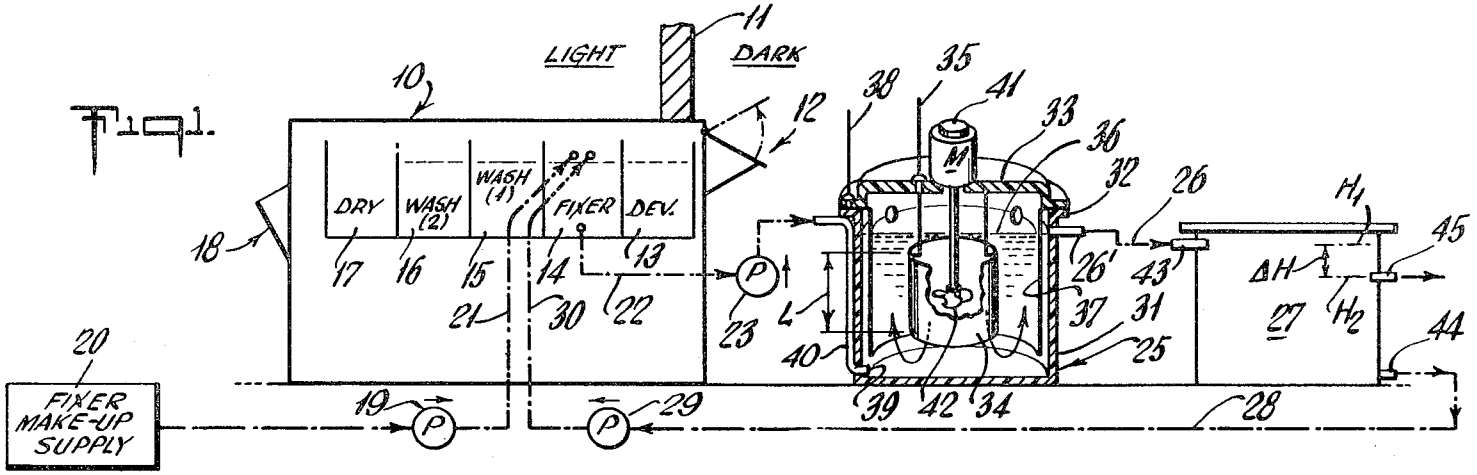
FIG. 1 is a simplified diagram schematically indicating components of a silver-recovery system of the invention.

In FIG. 1, the invention is shown in application to an intermittently operative or semi-automatic photo-development system, such as a machine 10 customarily installed in hospitals for development of X-ray negatives, promptly after exposure. The machine is installed in the wall 11 of a dark room where means 12 provides loading access, i.e., access for insertion of each exposed negative to be developed. Within the machine is a succession of tanks, for developer solution at 13, fixer solution at 14, and first and second washing or rinsing steps at 15–16. The machine 10 will be understood to include means (not shown) for the automatic transport of the inserted negative, into the developer at 13, thence to the successive baths 14–15–16, in timed sequence appropriate to the desired processing of the negative. The machine 10 will also be understood to include drying means (suggested at 17) preparatory to automatic delivery of the dried film at a delivery-access tray or door 18 outside the dark room.

The fixer-related part of machine 10 may include means such as a pump 19 connected to a supply 20 of fixer solution, for make-up or replenishment of the contents of bath 14, the same being shown connected via line 21 to discharge directly into bath 14. An overflow or exhaust line 22, which may be operated by pumps means 23, delivers excess used (silver-laden) fixer solution to a plating tank 25 of the invention, and tank 25 exhausts in a line 26 to a holding tank 27 forming part of return line 28–30, with pump means 29 for recycling the use of fixer solution at bath 14.

Basically, the plating tank 25 comprises an upwardly open cupped body 31 having a radial flange 32 for support and fastening of the flanged rim of a removable cover 33. The tank parts 31–32 present electrically insulated walls, both inside and outside, and may conveniently be of glass-fiber reinforced epoxy or other resin, molded to desired generally cylindrical internal contour. An open-ended cylindrical anode 34 is centrally suspended from the cover 33, one suspension point being provided with a terminal-lead connection 35; the effective cylindrical length L of anode 34 is fully submerged in fixer solution, i.e., spaced from the tank bottom and beneath the liquid level 36 established by placement of the overflow port 26' to line 26. An open-ended cylindrical cathode 37 concentrically surrounds the anode and is shown adjacent the tank wall, spaced from the tank bottom and having an upper flange by which it seats upon the tank-body flange 32; a lead connection to the cathode flange is externally accessible at 38. Inlet liquid from means 22–23 enters the lower part of tank 25 at a port 39 beneath the cathode, said port being shown as the bent lower end of a vertical pipe 40 which extends above the liquid level 36 and which is preferably imbedded in the tank body of the course of manufacture; such construction will be recognized as permitting simple detachable connection of hose or other supply plumbing, without having to drain the tank 25, and without weakening the anchorage of port 39. Finally, an electric motor 41 secured to cover 33 includes a shaft and impeller 42 extending concentrically within the anode, to promote a gentle toroidal flow as long as plating potential is applied at 35–38; preferably, the direction of such impelled flow is as suggested by arrows, namely, downward within the anode 34, radially outward beneath the anode, upward between the electrodes 34–37, and radially inward above the anode.

The holding tank 27 may be a simple covered vessel having inlet and outlet ports 43–44 forming part of the recycling circuit already described. However, the periodic addition of make-up solution from supply 20 creates a need for discharge of excess processed solution, preferably at tank 27. This need may be met by a simple overflow drain port 45 or, if desired, automatic valve means (not shown) may be provided to permit accumulation to an upper lever $H_1$ before release via port 45, thus effecting relatively infrequent discharge of the head or difference $\Delta H$ between upper and lower levels $H_1$–$H_2$.

Figure 2:
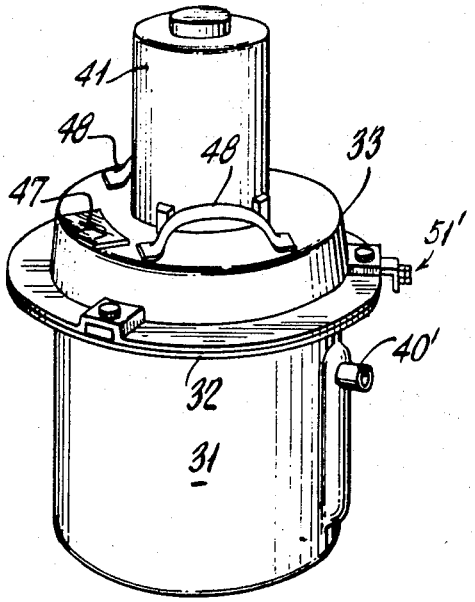
FIG. 2 is a perspective view of a silver-recovery tank unit, forming part of the system of FIG. 1.
Figure 3:
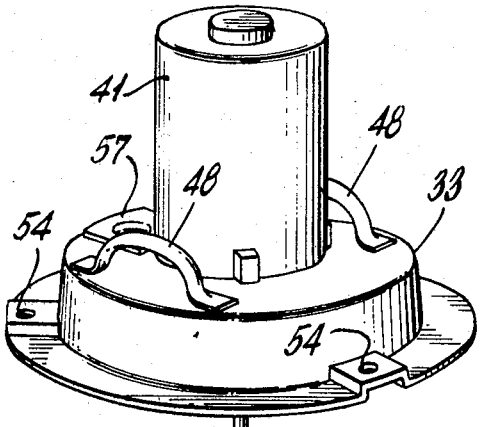
FIG. 3 is an exploded view in perspective showing removal of the cover assembly from the tank unit of FIG. 2, as for servicing or inspection.

FIGS. 2 and 3 show greater detail of a plating tank which differs only slightly from the plating tank described in connection with FIG. 1; for this reason, the same reference numbers are adopted for the same or corresponding parts. The inlet pipe 40 is seen to be imbedded in the tank-body material and to present a standard fitting 40' for detachable plumbing connection. A window 47 in cover 33 permits viewing of tank contents without disburbing a secured closure of the tank, and spaced handles 48 on the cover provide simplified manipulation of the cover and all parts subassembled thereto.

In FIGS. 2 and 3 there are differences in detail (compared to FIG. 1) as to the manner of support of the anode and cathode members 34–37, but their placement and effective areas remain the same. Specifically, the cathode 37 fits closely to the inner wall surface of the tank body 31, and is positioned just below the level of flange 32, being held in place by spaced radial bolts 49 which are above the level 36 and which extend through the body 31; one of these bolts 49 has an extended shank 49' and serves as the cathode-lead terminal. The anode 34 is suspended from a spider structure comprising an upper ring 50 and spaced radially outward arms 51; ring 50 is of substantially the diameter of the anode, and spaced straps 52 tie the inner wall of the anode to the suspension ring 50. A projection or bracket formation 51' on one of the arms 51 provides electrical lead-connection access to the anode 34. Mounting holes in arms 51 locate on upstanding studs 53, which are preferably anchored in the plastic body of flange 32.

The tank assembly is secured by applying a suitable gasket (not shown) to flange 32 before registration of cover holes 54 with studs 53, at which time stud nuts may be applied. The application of nuts to studs 53 is found to be necessary only to discourage tampering, because entirely satisfactory performance is achieved by merely placing the cover assembly over the tank-body assembly.

As to the impeller 42, good toroidal flow is achieved for a variety of axial placements. Generally, it is preferred that the impeller be located within the anode, at least below the upper end of the anode, and it may be as low as the bottom surface of the tank. If the impeller is located near the lower end of the anode, it is desired to use the tank bottom as a stabilizing reference for impeller-shaft rotation. Thus, in FIG. 3, a bearing 55 such as a nylon or Mylar bushing is shown embedded at the center of the tank bottom, for guided reception of the projecting end 42' of the impeller shaft.

The drawings reflect preference for the use of stainless sheet-metal electrodes 34–37 and associated suspension structure. In a highly satisfactory employment of the invention, each electrode is of type 316 stainless steel, approximately 1/16-inch thick, although thickness in the range of 0.015 to 0.150 inch will also be satisfactory. A cathode diameter of 16 inches is well accommodated in a tank bore of 16⅛ inches, and an associated anode of 8-inch diameter provides an effective relationship. Of course, electrode length is a function of tank capacity; for five or ten-gallon capacity, anode length is approximately five or ten inches, respectively, and cathode lengths are scaled accordingly. Titanium bolts are preferred at 49–53.

Figure 4:
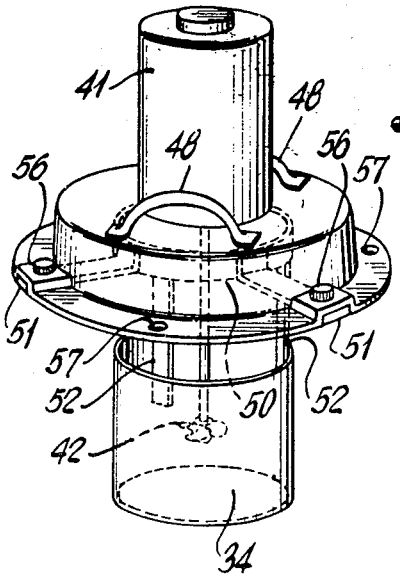
FIG. 4 is a similar view of an alternative cover assembly.
Figure 4:
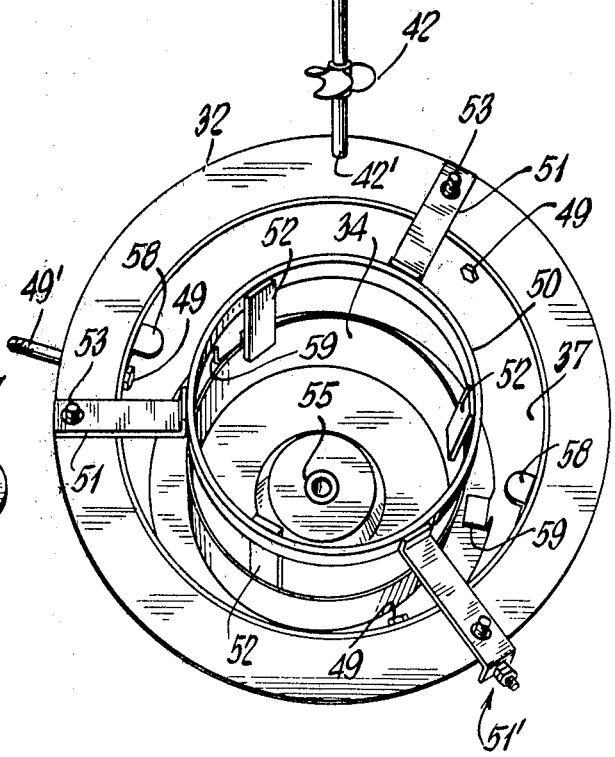

FIG. 4 illustrates a slightly modified cover assembly wherein the anode 34 and its suspension structure 50–51–52 are secured by bolt means 56 to the flange of cover 33. Mounting holes 57 in this flange register with studs 53, to secure the full tank assembly. And the shaft for impeller 42 is short enough to be fully contained within the included volume of the anode 34. Thus, upon removal of the cover assembly, it may be stood to the side of the tank body 31, resting upon the base of the anode 34.

In the periodic servicing of the described plating-tank structures, the cover assembly is removed and the anode assembly is removed. Access is then presented for removal of the cathode, the bore of which may be laden with as much as a one-inch thickness of high-quality metallic silver; in FIG. 3, inward brackets 58 at diametrically opposite locations on the cathode provide lifting access for removal of the cathode, while positioning feet 59 maintain a desired spacing from the tank bottom and also provide a convenient footing when the cathode is removed from the tank. Metal silver is then removed from the cahode by fracturing, as by sharp application of one or more mallet blows to the outer surface of the cathode; alternatively, the silver may be removed by melting. Both electrodes may then be immediately restored to service, although as a practical matter, a substitute cathode will probably be installed, to permit the loaded cathode to be shipped remotely, for silver removal and then for reuse.

Figure 5:
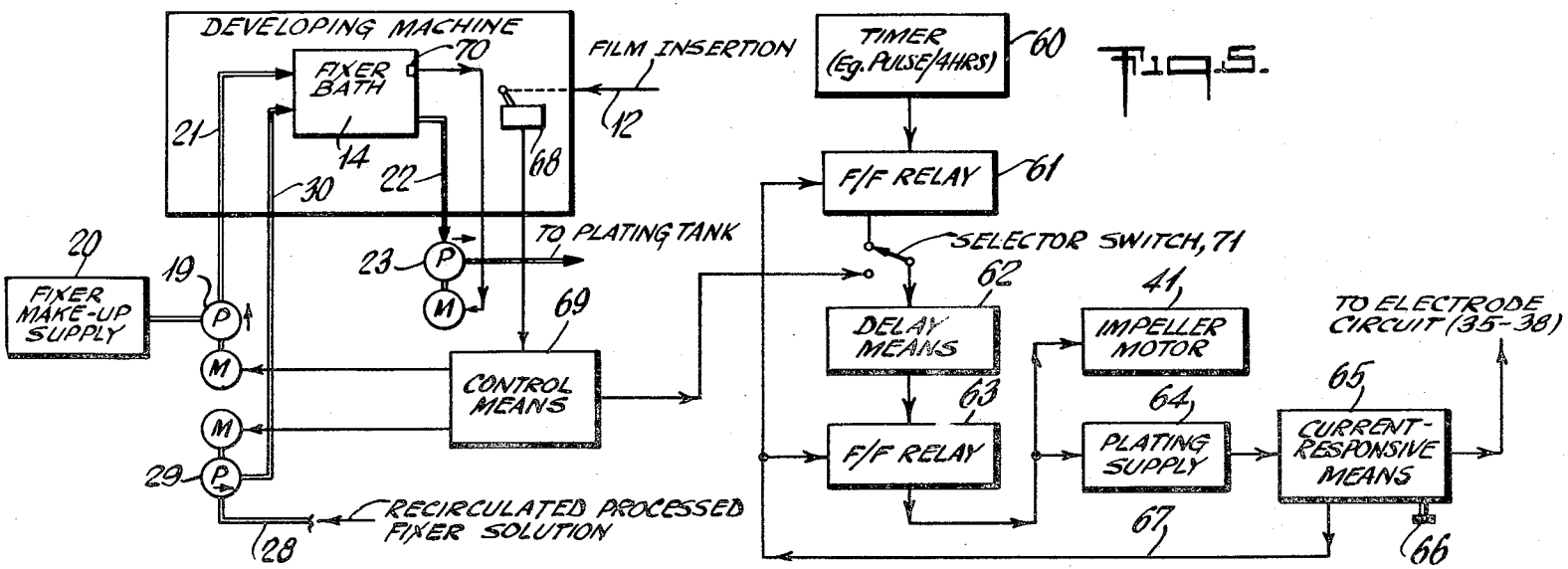
FIG. 5 is an electrical and hydraulic circuit diagram, to show means for implementing use of the system of FIG. 1.

The circuit diagram of FIG. 5 shows two control arrangements, either or both of which may be used in the automatic operation of the described system. One of these control techniques, shown available for the "up" position of a selector switch 71, relies upon a timer 60, which may be set to deliver a control pulse once for each given selected interval, for example one pulse every four hours. This pulse is shown connected to a bistable flip-flop relay 61, the connection being such that a starting signal is imparted via delay means 62 to another flip-flop relay 63; it being understood that passage of a predetermined delay at 62 is a condition precedent to establishing a starting condition of relay 63. Once relay 63 operates, excitation controls are established for the impeller motor 41 and for the plating supply 64 to the electrode circuit 35–38. Included in one arm of this circuit is current-responsive means 65, set by selectively adjustable means 66, to produce an output signal in a control line 67 should the detected plating-circuit current be less than a predetermined level. Such a signal in line 67 is used, by connection to the relays 61–63, to disable the starting mechanism, thereby avoiding a start up should the current level be of pre-selected insufficient amplitude. It will be understood that the delay at 62 should be at least sufficient to assure termination of the timer pulse at 60, before excitation of the plating circuit. By this means, one is assured that, if inadequate plating-circuit current flow is detected, then the timer 60 will be ineffective to attempt another plating start-up, until passage of the selected time interval for the next pulse, here assumed to be another four hours.

The other control technique, which may be concurrently operative with timer 60, but which through selector-switch operation may be the sole operating control for the plating circuit, relies upon operation of the developing machine 10. As shown, this machine includes a limit switch 68 having a probe arm poised to respond to a film insertion at 12. Such a switch 68 or its equivalent is to be found in most photodeveloping machines and is relied upon, via suitable control means 69, to operate valves or to drive displacement pumps for the predetermined incremental supply of replenishment developer and fixer, from make-up supplies of stock solution; the present situation is concerned solely with adaptation to the fixer solution and its supply 20, which will be understood to be briefly drawn, to the extent of a predetermined volume $V_1$ by operation of pump 19 under the control of means 69. Concurrently, control means 69 is connected to pump means 29 to deliver into bath 14 a predetermined volume $V_2$ of recycling fixer solution, from the holding tank 27; and control means 69 is further connected to provide a starting input to the delay means 62. It will be understood that adjustments are made to assure a correct proportioning of the indicated volumes, such that the minimum necessary fresh chemicals are drawn from the supply 20. At the same time, means 70 responsive to fixer level in bath 14 is operatively connected to pump means 23 to draw off used, silver-laden fixer from tank 14, in a quantity to maintain the desired fixer-bath level.

The used fixer is of course supplied directly to tank 25, and it may contain enough silver enrichment to the contents of tank 25 to enable a plating operation. This condition is tested by the current-responsive means 65, already described. If there is an inadequate current, the plating circuit is restored to shut-down condition, but if the current is at an adequate level, the described toroidal flow and plating action proceed, until means 65 functions to shut down the plating through having detected the minimum acceptable current level.

It will be seen that the invention meets all stated objects with a relatively simple and inherently clean plating-tank structure. The arrangement, control and choice of materials are such that electrodes are repeatedly reusable; as much as 98 percent of the available silver is reclaimed; the processed fixer is recycled; no gases are given off to the surrounding space (which in the case of a hospital dark room is very confined); and no solution is "burned" by excessive current at high voltage. For example, for the indicated anode and cathode dimensions, and for a relatively high plating potential of 5 volts, current can range up to 15 amperes without burning the silver, but preferably the current is held to a level in the range 2 to 7.5 amperes; the maximum current being determined by assuring sufficiently frequent attempts at plating, as by shortening the pulse interval at timer 60 should the fixer bath be called upon to carry heavy and continuous use.

While the invention has been described in detail for the preferred forms shown, it will be understood that modifications may be made without departing from the invention. For example, by reversing the polarity of plating potential applied to the electrodes 34–37, the outer electrode becomes the anode and the inner electrode becomes the cathode, in which case metallic silver is plated upon the outer surface of the inner electrode. Use of the expressions "cathode" and "anode" in application to the electrodes 34–37 will thus be understood to be illustrative, rather than limiting, in the present context.

What is claimed is:

1. An electrochemical device for recovering a precious metal from an electrolyte solution containing ions of said metal, comprising a tank having an upwardly open end and a cover removably securable over the open end of said tank, said tank having an upper spillway port determining a liquid-capacity level within the tank, said tank having an inlet port communicating with the bottom region within the tank, a hollow open-ended cylindrical first electrode of stainless metal fixedly supported by said cover on an upstanding axis and positioned between and in clearance relation above said bottom region and beneath said level, a fixedly positioned hollow cylindrical second electrode of stainless metal having upper and lower open ends and concentrically surrounding and radially spaced from said first electrode, and flow-impelling means spaced from said electrodes and carried by said cover and effectively within the geometrical cylinder of the hollow of said first electrode, whereby a recirculating toroidal liquid flow is established in opposite axial directions on the respective inner and outer sides of said first electrode.

2. A device according to claim 1, wherein the inlet port is at the lower end of said second electrode.

3. A device according to claim 1, wherein said electrodes are oppositely polarized as anode and cathode, respectively, and said impelling means is driven in the direction of producing downward flow within said first electrode and upward flow within the space between said electrodes.

4. A device according to claim 1, in which said flow-impelling means comprises a motor mounted on said cover and an impeller shaft driven by said motor and extending coaxially within said first electrode.

5. A device according to claim 4, in which said first electrode and impelling means are carried as a unit-handling assembly with said cover.

6. An electrochemical device for recovering a precious metal from an electrolyte solution containing ions of said metal, comprising an upwardly open tank having a predetermined upper level of liquid-capacity, a hollow open-ended stationary cylindrical anode positioned in said tank on an upstanding axis and located in clearance relation above the tank bottom and beneath said level, flow-impelling means generally on the anode axis for generating a recirculating toroidal flow of liquid in opposite axial directions on the respective inner and outer sides of said anode, and an open-ended stationary cylindrical cathode surrounding and radially spaced from said anode and positioned for exposure to the axial direction of flow outside said anode.

7. An electrochemical device for recovering a precious metal from an electrolyte solution containing ions of said metal, comprising a generally cylindrical tank on an upstanding axis, said tank having a predetermined upper level of liquid capacity, an open-ended stationary cylindrical cathode concentrically supported within said tank, an open-ended stationary anode concentrically supported in radially spaced relation within said cathode and being totally beneath said predetermined level and axially spaced from the tank bottom, and impeller means on said axis and positioned beneath said level to develop a recirculatory toroidal flow of liquid in said tank, the direction of operation of said impeller means being such as to induce upward flow in the space between said anode and cathode.

8. An electrochemical device for recovering a precious metal from an electrolyte solution containing ions of said metal, comprising a tank openable at its upper end and having a predetermined upper level of liquid capacity, a stationary hollow open-ended cylindrical first electrode positioned in said tank on an upstanding axis and located in clearance relation above the tank bottom and below said predetermined upper level; whereby when said tank is liquid-filled to said level, said first electrode toroidally divides said liquid into a radially inner zone and a radially outer zone with said zones freely liquid-connected at each of the axial ends of said first electrode; flow-impelling means spaced from and symmetrical about an upstanding axis which includes the axis of said electrode, said flow-impelling means being movable for generating a toroidal recirculating flow of liquid in opposite axial directions in said respective inner and outer zones, and a stationary open-ended cylindrical second electrode surrounding and radially spaced from said first electrode and internally exposed to liquid in said outer zone.

9. The devices of claim 8, in which the openable end of said tank includes a cover and means for removably securing and sealing the same in the tank-closed condition.

10. An electrochemical device for recovering a precious metal from an electrolyte solution containing ions of said metal, comprising an upwardly open tank having an upper spillway port determining a liquid-capacity level within the tank, said tank having an inlet port communicating directly with the bottom region within the tank, a hollow open-ended stationary cylindrical first electrode of stainless metal positioned in said tank on an upstanding axis and located in clearance relation above said bottom region and beneath said level, a hollow open-ended stationary cylindrical second electrode of stainless metal having upper and lower open ends and concentrically surrounding and radially spaced from said first electrode, and means for impressing a unidirectional plating potential upon said device by opposed-polarity connection to said respective electrodes, whereby said electrodes become anode and cathode, respectively, with plating action on the cathode and in the annular region between said electrodes, thereby locally reducing the density of solution between said electrodes as compared to local density of solution within the inner electrode, so that in the course of plating at the cathode a toroidal circulation of solution may be induced upward between said electrodes and downward within the inner electrode, and so that upwardly-flowing solution reaching the level of the top of said inner electrode may spill to the space within said inner electrode for recirculation downward within said inner electrode.

11. An electrochemical device for recovering a precious metal from an electrolyte solution containing ions of said metal, comprising an upwardly open tank having an upper spillway port determining a liquid-capacity level within the tank, said tank having an inlet port communicating with the bottom region within the tank, a hollow open-ended stationary cylindrical first electrode of stainless metal positioned in said tank on an upstanding axis and located in clearance relation above said bottom region and beneath said level, a hollow open-ended stationary cylindrical second electrode of stainless metal having upper and lower open ends and concentrically surrounding and radially spaced from said first electrode, and flow-impelling means spaced from said electrodes and beneath said capacity level for aid of toroidal recirculation of liquid flow upward in the space between said electrodes and downward in the space within the inner electrode.

12. An electrochemical device for recovering a precious metal from an electrolyte solution containing ions of said metal, comprising an upwardly open tank having an upper spillway port determining a liquid-capacity level within the tank, said tank having an inlet port communicating directly with the bottom region within the tank, a hollow open-ended stationary cylindrical anode of stainless metal positioned in said tank on an upstanding axis and located in clearance relation above said bottom region and beneath said level, a hollow open-ended stationary cylindrical cathode of stainless metal having upper and lower open ends and concentrically surrounding and radially spaced from said anode, and electroplating-potential supply means connected to said anode and cathode, whereby plating action develops on the cathode and in the annular region between said anode and cathode, thereby locally reducing the density of solution between said anode and cathode as compared to local density of solution within said anode, so that in the course of plating at the cathode a toroidal circulation of solution is induced upward between said anode and cathode and downward within said anode, and so that upwardly-flowing solution reaching the level of the top of said anode may spill to the space within said anode for recirculation downward within said anode.

13. A controlled electrochemical device for recovering silver from waste photographic-fixer solution, comprising a tank openable and closable at its upper end and having a predetermined upper level of liquid capacity, a stationary hollow open-ended cylindrical first electrode positioned in said tank on an upstanding axis and located in clearance relation above the tank bottom and below said predetermined upper level; whereby when said tank is liquid-filled to said level, said first electrode toroidally divides said liquid into a radially inner zone and a radially outer zone with said zones freely liquid-connected at each of the axial ends of said first electrode; flow-impelling means spaced from said electrode and symmetrical about an upstanding axis which includes the axis of said electrode, said flow-impelling means being movable for generating a toroidal circulating flow of liquid in opposite axial directions in said respective inner and outer zones, and a stationary open-ended cylindrical second electrode surrounding and radially spaced from said first electrode and internally exposed to liquid in said outer zone; fixer-bath means including exhaust outlet means and replenisher inlet means, a supply connection from said outlet means to said tank, said tank including an upper-level discharge outlet for exhausting processed liquid, automatic plating-potential supply means connected to said electrodes and including current-sensitive control means connected to said electrodes for supplying sustained plating potential to said electrodes only in the event of a detected current exceeding a predetermined level, a recycling connection from said discharge outlet to said replenisher inlet means, and means coordinated by flow in said recycling connection and including a fresh-fixer supply connection for introducing fresh fixer at said replenisher inlet means in a predetermined relation to the flow in said recycling connection.

14. Automatic means according to claim 13, in which said coordinating means includes motor-driven pumps in the respective recycling and fresh-fixer connections to said replenisher inlet means, and control means for driving said pumps to effect said predetermined flow relation.

15. Automatic means according to claim 14, in which said recycling connection includes a holding tank.

16. Automatic means according to claim 13, in which said fixer-bath means is part of an automatic intermittently operated photo-processing system wherein a fresh-fixer supply is actuated to introduce a predetermined quantity of fresh fixer solution at said inlet means upon introduction of a photographic work piece calling for development, and means coordinated with such actuation for initiating the supply of plating potential to said electrodes.

17. Automatic means according to claim 13, in which said fixer-bath means is part of an automatic intermittently operated photo-processing system wherein a fresh-fixer supply is actuated to introduce a predetermined quantity of fresh fixer solution at said inlet means upon introduction of a photographic work piece calling for development, and means coordinated with such actuation for initiating flow in said recycling connection.

18. A controlled electrochemical device for recovering silver from waste photographic-fixer solution, comprising a tank openable and closable at its upper end and having a predetermined upper level of liquid capacity, a stationary hollow open-ended cylindrical first electrode positioned in said tank on an upstanding axis and located in clearance relation above the tank bottom and below said predetermined upper level; whereby when said tank is liquid-filled to said level, said first electrode toroidally divides said liquid into a radially inner zone and a radially outer zone with said zones freely liquid-connected at each of the axial ends of said first electrodes; flow-impelling means spaced from said electrode and symmetrical about an upstanding axis which includes the axis of said electrode; said flow-impelling means being movable for generating a toroidal circulating flow of liquid in opposite axial directions in said respective inner and outer zones, and a stationary open-ended cylindrical second electrode surrounding and radially spaced from said first electrode and internally exposed to liquid in said outer zone; control means connected to said electrodes for supplying said electrodes with a plating-excitation potential, said control means comprising current-responsive means operative to disable the supply connection upon detection of an excitation current of less than a predetermined minimum value, said predetermined minimum being that applicable to a substantially silver-exhausted condition of waste-fixer liquid in said tank, and intermittently operative means for periodically exciting said electrodes at plating potential, whereby silver plating will only be allowed to proceed if a current can be passed in excess of said predetermined minimum value.

19. Automatic means according to claim 18, wherein said intermittently operative means includes a timer preset to apply plating-excitation potential to said electrodes at predetermined intervals.

20. Automatic means according to claim 17, wherein said intermittently operative means includes a photo-developing machine having a fixer bath with a discharge connection to said tank, and a control connection from said machine to said control means.

21. Automatic means according to claim 19, in which said machine includes a fixer stock-solution supply and means governing the periodic admission of a predetermined quantity of fixer stock-solution from said supply to said bath, said control connection including means responsive to an operation of said governing means.

22. An electrochemical device for recovering silver from waste photographic-fixer solution, comprising a tank having an upwardly open end and a cover removably securable over the open end of said tank, said tank having an upper spillway port determining a liquid-capacity level within the tank, said tank having an inlet port communicating with the bottom region within the tank, a hollow open-ended cylindrical first electrode of stainless metal fixedly supported by said cover on an upstanding axis and positioned between and in clearance relation above said bottom region and beneath said level, a fixedly positioned hollow cylindrical second electrode of stainless metal having upper and lower open ends and concentrically surrounding and radially spaced from said first electrode, and flow-impelling means spaced from said electrodes and carried by said cover and effectively within the geometrical cylinder of the hollow of said first electrode, whereby a recirculating toroidal liquid flow is established in opposite axial directions on the respective inner and outer sides of said first electrode.

23. A device according to claim 22, wherein the inlet port is at the lower end of said second electrode.

24. A device according to claim 22, wherein said electrodes are oppositely polarized as anode and cathode, respectively, and said impelling means is driven in the direction of producing downward flow within said first electrode and upward flow within the space between said electrodes.

25. A device according to claim 22, in which said flow-impelling means comprises a motor mounted on said cover and an impeller shaft driven by said motor and extending coaxially within said first electrode.

26. A device according to claim 25, in which said first electrode and impelling means are carried as a unit-handling assembly with said cover.

27. An electrochemical device for recovering silver from waste photographic-fixer solution, comprising an upwardly open tank having a predetermined upper level of liquid-capacity, a hollow open-ended stationary cylindrical anode positioned in said tank on an upstanding axis and located in clearance relation above the tank bottom and beneath said level, flow-impelling means generally on the anode axis for generating a recirculating toroidal flow of liquid in opposite axial directions on the respective inner and outer sides of said anode, and an open-ended stationary cylindrical cathode surrounding and radially spaced from said anode and positioned for exposure to the axial direction of flow outside said anode.

28. An electrochemical device for recovering silver from waste photographic-fixer solution, comprising a generally cylindrical tank on an upstanding axis, said tank having a predetermined upper level of liquid capacity, an open-ended stationary cylindrical cathode concentrically supported within said tank, an open-ended stationary anode concentrically supported in radially spaced relation within said cathode and being totally beneath said predetermined level and axially spaced from the tank bottom, and impeller means on said axis and positioned beneath said level to develop a recirculatory toroidal flow of liquid in said tank, the direction of operation of said impeller means being such as to induce upward flow in the space between said anode and cathode.

29. An electrochemical device for recovering silver from waste photographic-fixer solution, comprising a tank openable at its upper end and having a predetermined upper level of liquid capacity, a stationary hollow open-ended cylindrical first electrode positioned in said tank on an upstanding axis and located in clearance relation above the tank bottom and below said predetermined upper level; whereby when said tank is liquid-filled to said level, said first electrode toroidally divides said liquid into a radially inner zone and a radially outer zone with said zones freely liquid-connected at each of the axial ends of said first electrode; flow-impelling means spaced from and symmetrical about an upstanding axis which includes the axis of said electrode, said flow-impelling means being movable for generating a toroidal recirculating flow of liquid in opposite axial directions in said respective inner and outer zones, and a stationary open-ended cylindrical second electrode surrounding and radially spaced from said first electrode and internally exposed to liquid in said outer zone.

30. The device of claim 29, in which the openable end of said tank includes a cover and means for removably securing and sealing the same in the tank-closed condition.

31. An electrochemical device for recovering silver from waste photographic-fixer solution, comprising an upwardly open tank having an upper spillway port determining a liquid-capacity level within the tank, said tank having an inlet port communicating directly with the bottom region within the tank, a hollow open-ended stationary cylindrical first electrode of stainless metal positioned in said tank on an upstanding axis and located in clearance relation above said bottom region and beneath said level, a hollow open-ended stationary cylindrical second electrode of stainless metal having upper and lower open ends and concentrically surrounding and radially spaced from said first electrode, and means for impressing a unidirectional plating potential upon said device by opposed-polarity connection to said respective electrodes, whereby said electrodes become anode and cathode, respectively, with plating action on the cathode and in the annular region between said electrodes, thereby locally reducing the density of solution between said electrodes as compared to local density of solution within the inner electrode, so that in the course of plating at the cathode a toroidal circulation of solution may be induced upward between said electrodes and downward within the inner electrode, and so that upwardly-flowing solution reaching the level of the top of said inner electrode may spill to the space within said inner electrode for recirculation downward within said inner electrode.

32. An electrochemical device for recovering silver from waste photographic-fixer solution, comprising an upwardly open tank having an upper spillway port determining a liquid-capacity level within the tank, said tank having an inlet port communicating with the bottom region within the tank, a hollow open-ended stationary cylindrical first electrode of stainless metal positioned in said tank on an upstanding axis and located in clearance relation above said bottom region and beneath said level, a hollow open-ended stationary cylindrical second electrode of stainless metal having upper and lower open ends and concentrically surrounding and radially spaced from said first electrode, and flow-impelling means spaced from said electrodes and beneath said capacity level for aid of toroidal recirculation of liquid flow upward in the spaces between said electrodes and downward in the space within the inner electrode.

33. An electrochemical device for recovering silver from waste photographic-fixer solution, comprising an upwardly open tank having an upper spillway port determining a liquid-capacity level within the tank, said tank having an inlet-port communicating directly with the bottom region within the tank, a hollow open-ended stationary cylindrical anode of stainless metal positioned in said tank on an upstanding axis and located in clearance relation above said bottom region and beneath said level, a hollow open-ended stationary cylindrical cathode of stainless metal having upper and lower open ends and concentrically surrounding and radially spaced from said anode, and electroplating-potential supply means connected to said anode and cathode, whereby plating action develops on the cathode and in the annular region between said anode and cathode, thereby locally reducing the density of solution between said anode and cathode as compared to local density of solution within said anode, so that in the course of plating at the cathode a toroidal circulation of solution is induced upward between said anode and cathode and downward within said anode, and so that upwardly-flowing solution reaching the level of the top of said anode may spill to the space within said anode for recirculation downward within said anode.

* * * * *